US011543118B1

(12) United States Patent
Zhan

(10) Patent No.: US 11,543,118 B1
(45) Date of Patent: Jan. 3, 2023

(54) IRIDESCENT INTELLIGENT BATHROOM MIRROR

(71) Applicant: ZHONGSHAN CHENGJIANG GLASS CRAFT CO., LTD., Zhongshan (CN)

(72) Inventor: Weijiang Zhan, Zhanjiang (CN)

(73) Assignee: ZHONGSHAN CHENGJIANG GLASS CRAFT CO., LTD., Zhongshan (CN)

( * ) Notice: Subject to any disclaimer, the term of this patent is extended or adjusted under 35 U.S.C. 154(b) by 0 days.

(21) Appl. No.: 17/394,430

(22) Filed: Aug. 5, 2021

(51) Int. Cl.

| | |
|---|---|
| ***F21V 33/00*** | (2006.01) |
| ***F21S 4/20*** | (2016.01) |
| ***A47G 1/06*** | (2006.01) |
| ***F21V 23/04*** | (2006.01) |
| ***H05B 3/84*** | (2006.01) |
| ***F21Y 115/10*** | (2016.01) |

(52) U.S. Cl.
CPC ..... *F21V 33/004* (2013.01); *A47G 1/0622* (2013.01); *F21S 4/20* (2016.01); *F21V 23/0485* (2013.01); *H05B 3/845* (2013.01); *F21Y 2115/10* (2016.08)

(58) Field of Classification Search
CPC ... F21V 33/004; F21V 23/0485; H05B 3/845; F21S 4/20; A47G 1/0622; A47G 2200/08; F21Y 2115/10
See application file for complete search history.

(56) References Cited

FOREIGN PATENT DOCUMENTS

| | | | | | |
|---|---|---|---|---|---|
| CN | 109527891 | A | * | 3/2019 | |
| DE | 202018004110 | U1 | * | 10/2018 | |
| KR | 20110007576 | U | * | 8/2011 | |
| KR | 101584594 | B1 | * | 1/2016 | |
| KR | 101736433 | B1 | * | 5/2017 | |
| KR | 200484824 | Y1 | * | 10/2017 | |
| KR | 2018126725 | A | * | 11/2018 | ..... A47G 1/02 |
| WO | WO-2012035258 | A1 | * | 3/2012 | ..... A47G 1/02 |

* cited by examiner

*Primary Examiner* — Erin Kryukova

(57) ABSTRACT

The invention discloses an iridescent intelligent bathroom mirror, including a glass substrate, a control module, and a lamp strip module, wherein a front face of the glass substrate is provided with a reflecting area and a light emitting area, and a back face of the glass substrate is provided with a coaxial connecting frame; a periphery of an outside surface of the connecting frame is provided with a mounting groove; the lamp strip module includes an inner lamp strip and an RGB outer lamp strip; the inner lamp strip is arranged on the back face of the glass substrate; and the RGB outer lamp strip is arranged in the mounting groove.

9 Claims, 7 Drawing Sheets

24

IRIDESCENT INTELLIGENT BATHROOM MIRROR

TECHNICAL FIELD

The present invention relates to the field of bathroom mirror technologies, and more particularly, to an iridescent intelligent bathroom mirror.

BACKGROUND ART

A bathroom mirror for intelligent home is a kind of mirror used in a bathroom for intelligent home. With the changes of technology in eras, requirements of people for the bathroom mirror for intelligent home become higher.

However, a lamplight display area of an existing intelligent bathroom mirror is limited, with a single display effect, and a color cannot be set according to a requirement of a user, so that a bathroom scene with a self-defined and iridescent change cannot be created, and needs of the existing market cannot be met.

Meanwhile, the existing bathroom mirror is not only low in strength and easy to be damaged, but also easy to have a black edge due to the oxidation of an aluminium membrane or a silver membrane on a surface of the bathroom mirror after being used for a long time, thus affecting a service life.

SUMMARY OF THE PRESENT INVENTION

In order to overcome the defects of the prior art, the present invention aims to provide an iridescent intelligent bathroom mirror, which adopts a lamp strip module consisting of an inner lamp strip and an RGB outer lamp strip, by arranging the inner lamp strip on a light emitting area on a back face of a glass substrate, arranging the RGB outer lamp strip on a groove on an outside surface of a connecting frame, and then depending on actions of a control module, an inner lamp strip control switch, and an outer lamp strip control switch, a color and a brightness of the inner lamp strip and the RGB outer lamp strip are controlled, so that the bathroom mirror presents a color change effect of iridescent flowing water; and meanwhile, a toughened glass substrate is adopted, and a reflection enhancement layer, a metal layer, and a protective layer are sequentially arranged on a surface of the toughened glass substrate from inside to outside, so that a hardness of glass is increased, a brightness and an antioxidant capacity of glass are improved, and a service life of the bathroom mirror is prolonged.

In order to solve the above problem, the following technical solutions are used in the present invention.

An iridescent intelligent bathroom mirror includes a glass substrate, a control module, and a lamp strip module, wherein a front face of the glass substrate is provided with a reflecting area and a light emitting area, and a back face of the glass substrate is provided with a coaxial connecting frame; a periphery of an outside surface of the connecting frame is provided with a mounting groove;

the lamp strip module includes an inner lamp strip and an RGB outer lamp strip; the inner lamp strip is arranged on the back face of the glass substrate, and is located on the reflecting area; and the RGB outer lamp strip is arranged in the mounting groove; and the iridescent intelligent bathroom mirror further includes a demisting module, wherein the demisting module is arranged in a middle of the back face of the glass substrate; a touch switch set is arranged on the reflecting area; and the control module is electrically connected with the lamp strip module, the demisting module, and the touch switch set.

Preferably, the glass substrate is toughened glass; the reflecting area consists of a reflection enhancement layer, a metal layer, and a protective layer which are sequentially arranged from inside to outside; the reflection enhancement layer is use for enhancing reflection and improving a brightness; the metal layer is used for increasing a hardness of the glass substrate; and the protective layer is used for isolating erosion of oxygen from the metal layer.

Preferably, the control module includes a main control logic MCU circuit, a high-power lamp strip driving circuit, an RGB full-color driving control circuit, a demisting control circuit, and a power supply control circuit.

The main control logic MCU circuit is electrically connected with the touch switch set; the high-power lamp strip driving circuit and the RGB full-color driving control circuit are electrically connected with the lamp strip module; and the demisting control circuit is electrically connected with the demisting module.

Preferably, the demisting module includes an explosion-proof membrane and a heating sheet; the explosion-proof membrane is coaxially arranged with the glass substrate, and is pasted on the back face of the glass substrate on the reflecting area; the heating sheet is pasted on an outer surface of the explosion-proof membrane; and the heating sheet is electrically connected with the demisting control circuit.

Preferably, the reflection enhancement layer is a niobium oxide layer and a silicon oxide layer which are sequentially arranged from inside to outside or a titanium oxide layer and a silicon oxide layer or a pure silver layer which are sequentially arranged from inside to outside.

Preferably, the metal layer is a nichrome layer, a metal titanium lay, a metal chromium layer, or a metal copper layer.

Preferably, the protective layer is one or two of a paint layer or a silicon oxide layer, a niobium oxide layer, a titanium oxide layer, and a silicon nitride layer.

Preferably, the touch switch set includes a demisting switch, an inner lamp strip control switch, and an outer lamp strip control switch; and the inner lamp strip control switch and the outer lamp strip control switch are respectively used for changing a color and a brightness of the inner lamp strip and the RGB outer lamp strip, and are used for controlling on or off of the inner lamp strip and the RGB outer lamp strip.

Preferably, a cover plate is arranged on one side of the connecting frame far away from the glass substrate; and a waterproof sealing layer is arranged between the glass substrate and the connecting frame, between the connecting frame and the RGB outer lamp strip, and between the connecting frame and the cover plate.

Preferably, a surface on a light emitting side of the RGB outer lamp strip is in a frosted structure.

Compared with the prior art, the present invention has the following beneficial effects.

The present invention adopts the lamp strip module consisting of the inner lamp strip and the RGB outer lamp strip, by arranging the inner lamp strip on the light emitting area on the back face of the glass substrate, arranging the RGB outer lamp strip on the groove on the outside surface of the connecting frame, and then depending on the actions of the control module, the inner lamp strip control switch, and the outer lamp strip control switch, the color and the brightness of the inner lamp strip and the RGB outer lamp strip are controlled, so that the bathroom mirror presents the color change effect of iridescent flowing water; and meanwhile, the toughened glass substrate is adopted, and the reflection enhancement layer, the metal layer, and the protective layer are sequentially arranged on the surface of the toughened glass substrate from inside to outside, so that the hardness of glass is increased, the brightness and the antioxidant capacity of glass are improved, and the service life of the bathroom mirror is prolonged.

Figure 1:
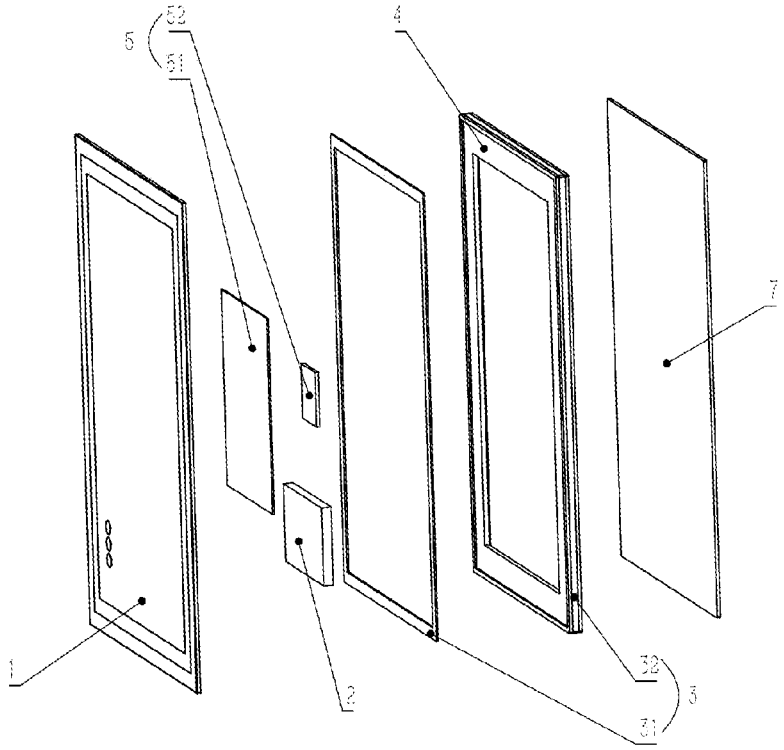
FIG. 1 is an overall stereoscopic structure diagram of the present invention.

in which: 1 refers to glass substrate, 2 refers to control module, 3 refers to lamp strip module, 4 refers to connecting frame, 5 refers to demisting module, 6 refers to touch switch set, 7 refers to cover plate, 11 refers to reflecting area, 12 refers to light emitting area, 21 refers to main control logic MCU circuit, 22 refers to high-power lamp strip driving circuit, 23 refers to RGB full-color driving control circuit, 24 refers to demisting control circuit, 25 refers to power supply control circuit, 31 refers to inner lamp strip, 32 refers to RGB outer lamp strip, 41 refers to mounting groove, 51 refers to explosion-proof membrane, 52 refers to heating sheet, 61 refers to demisting switch, 62 refers to inner lamp strip control switch, 63 refers to outer lamp strip control switch, 111 refers to reflection enhancement layer, 112 refers to metal layer, and 113 refers to protective layer.

DETAILED DESCRIPTION OF THE PREFERRED EMBODIMENTS

In order to facilitate the understanding of the present invention, the present invention will be described more comprehensively hereinafter with reference to the relevant accompanying drawings. Preferred embodiments of the present invention are shown in the accompanying drawings. However, the present invention may be implemented in many different forms and is not limited to the embodiments described herein. On the contrary, these embodiments are provided for understanding the disclosure of the present invention more thoroughly.

It should be noted that when the element is expressed to be "fixed" to another element, it may be directly on another element, or there may be an intermediate element in between. When one element is considered to be "connected" to another element, it may be directly connected to another element, or there may be an intermediate element in between. The terms "vertical", "horizontal", "left", "right", "upper", "lower" and similar expressions used herein are for illustrative purposes only.

Unless otherwise defined, all technical and scientific terms used in the text have the same meanings as those commonly understood by those skilled in the technical field of the present invention. The terms used in the specification of the present invention in the text are only for the purpose of describing specific embodiments, and are not used to limit the present invention. The term "and/or" used in the text includes any and all combinations of one or more associated listed items.

The present invention is further described hereinafter with reference to the accompanying drawings and the specific implementations.

As shown in FIG. 1 to FIG. 8, an iridescent intelligent bathroom mirror includes a glass substrate 1, a control module 2, and a lamp strip module 3. A front face of the glass substrate 1 is provided with a reflecting area 11 and a light emitting area 12, and a back face of the glass substrate is provided with a coaxial connecting frame 4. A periphery of an outside surface of the connecting frame 4 is provided with a mounting groove 41.

The lamp strip module 3 includes an inner lamp strip 31 and an RGB outer lamp strip 32. The inner lamp strip 31 is arranged on the back face of the glass substrate 1, and is located on the reflecting area 12. The RGB outer lamp strip 32 is arranged in the mounting groove 41.

The iridescent intelligent bathroom mirror further includes a demisting module 5. The demisting module 5 is arranged in a middle of the back face of the glass substrate 1. A touch switch set 6 is arranged on the reflecting area 11. The control module 2 is electrically connected with the lamp strip module 3, the demisting module 5, and the touch switch set 6.

In the embodiment, the lamp strip module 3 consisting of the inner lamp strip and the RGB outer lamp strip is adopted. The inner lamp strip is arranged on the light emitting area 12 on the back face of the glass substrate 1, the RGB outer lamp strip is arranged on the groove on the outside surface of the connecting frame, so that the bathroom mirror has a better stereoscopic effect through front and back distribution of the lamp strips, and a rich visual effect can be better presented.

Figure 3:
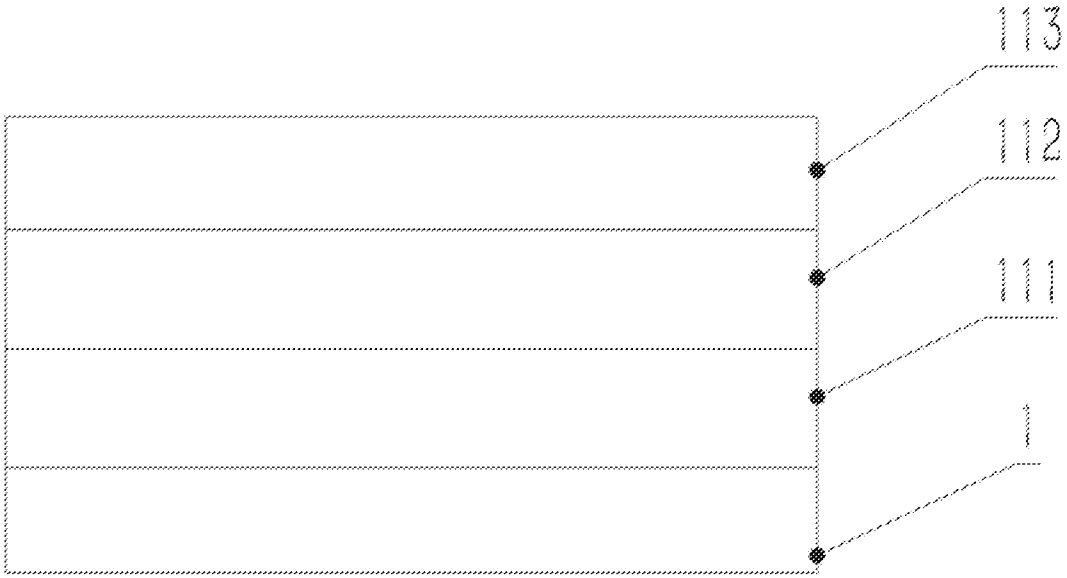
FIG. 3 is a schematic structure diagram of a glass substrate in the present invention.
Figure 4:
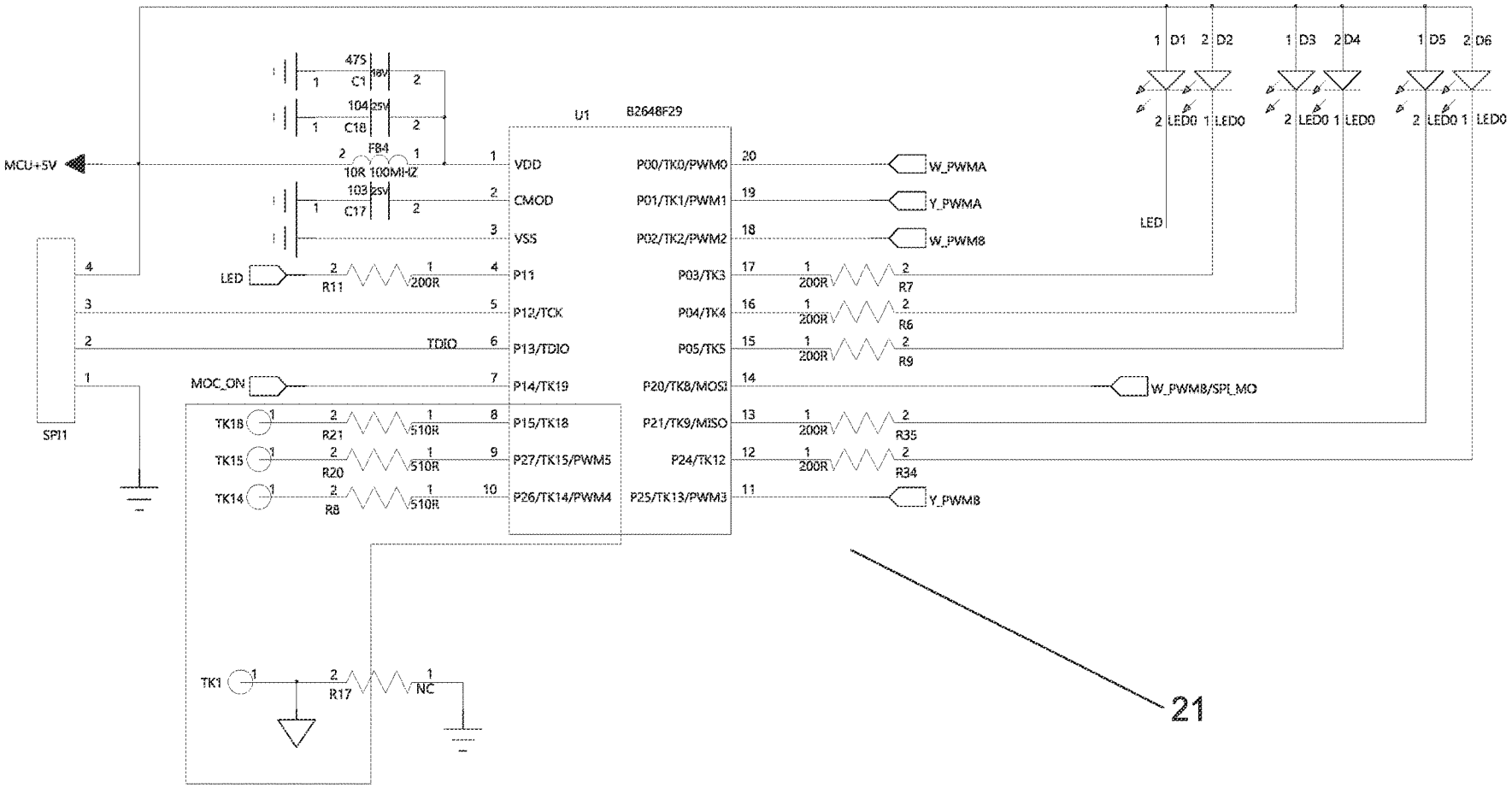
FIG. 4 a circuit diagram of a main control logic MCU circuit in the present invention.
Figure 5:
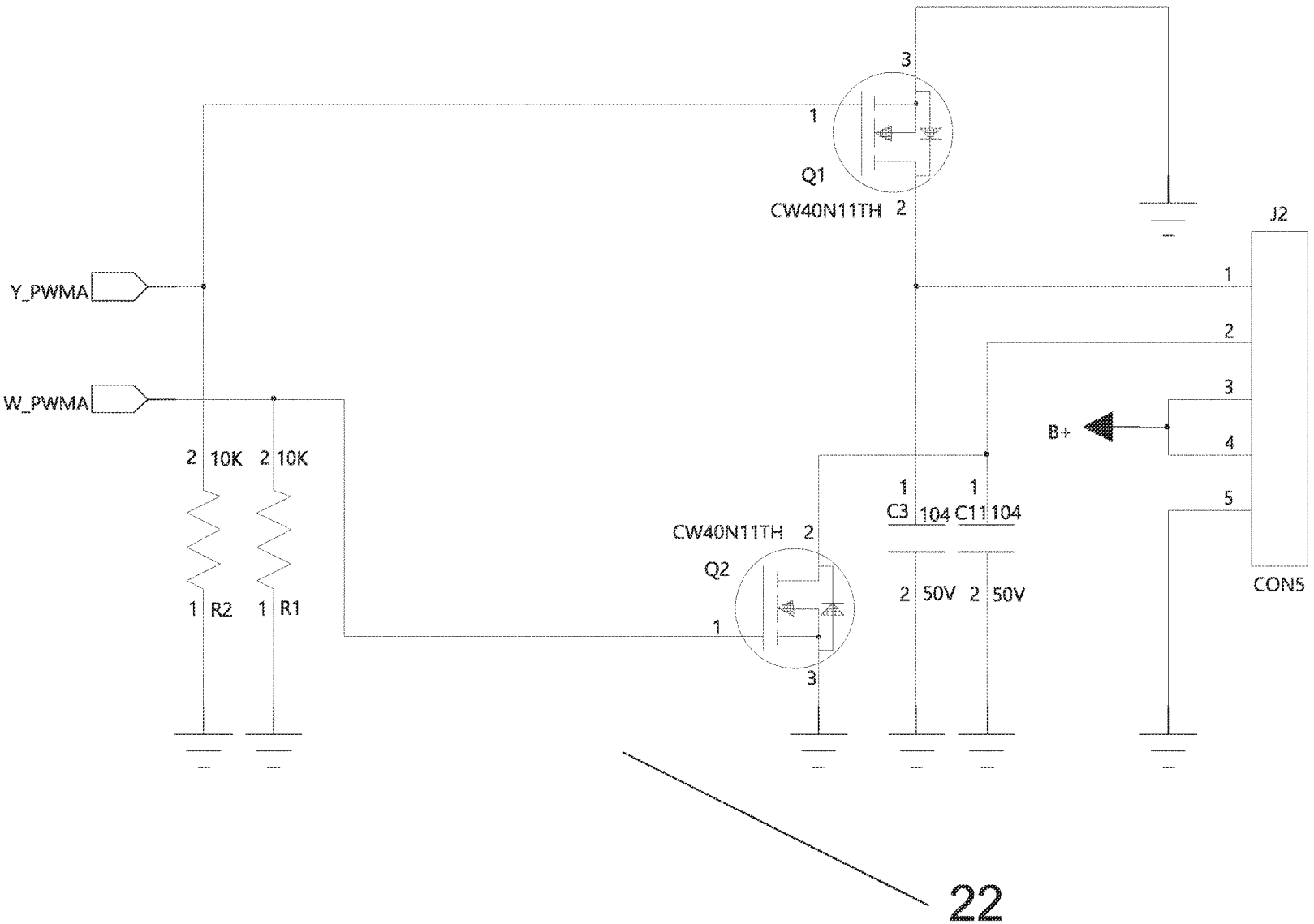
FIG. 5 a circuit diagram of a high-power lamp strip driving circuit in the present invention.
Figure 6:
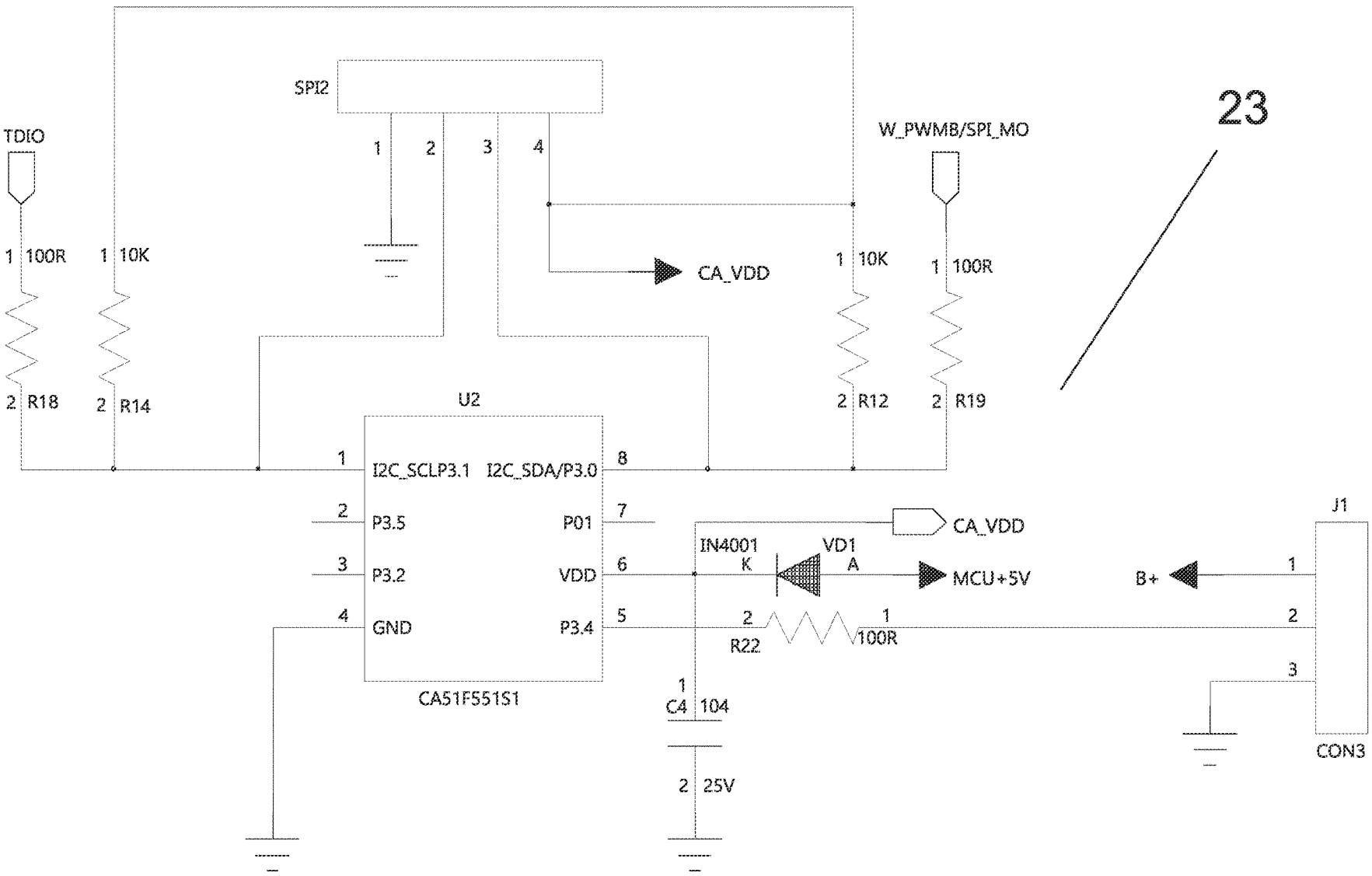
FIG. 6 a circuit diagram of an RGB full-color driving control circuit in the present invention.
Figure 7:
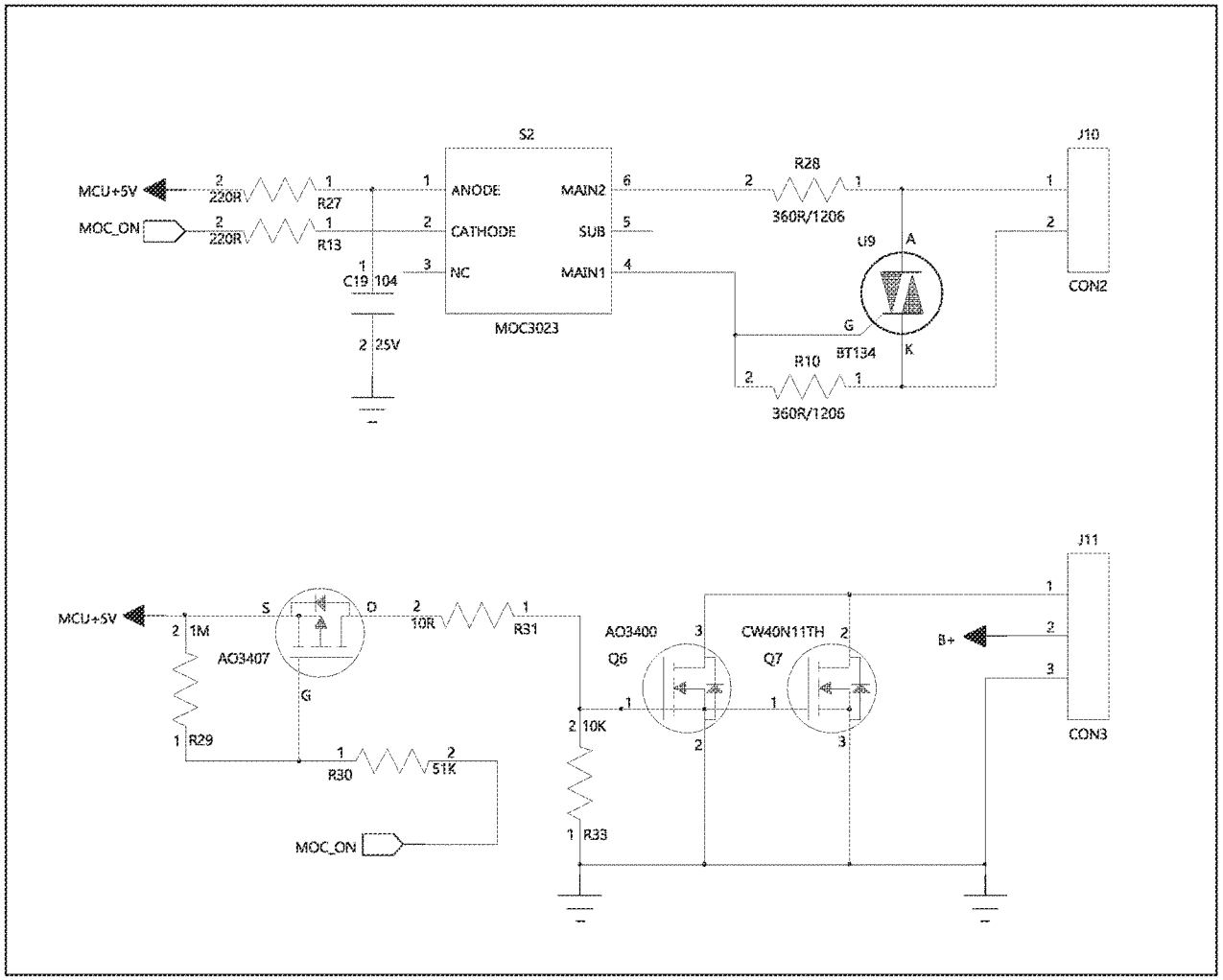
FIG. 7 a circuit diagram of a demisting control circuit in the present invention.
Figure 8:
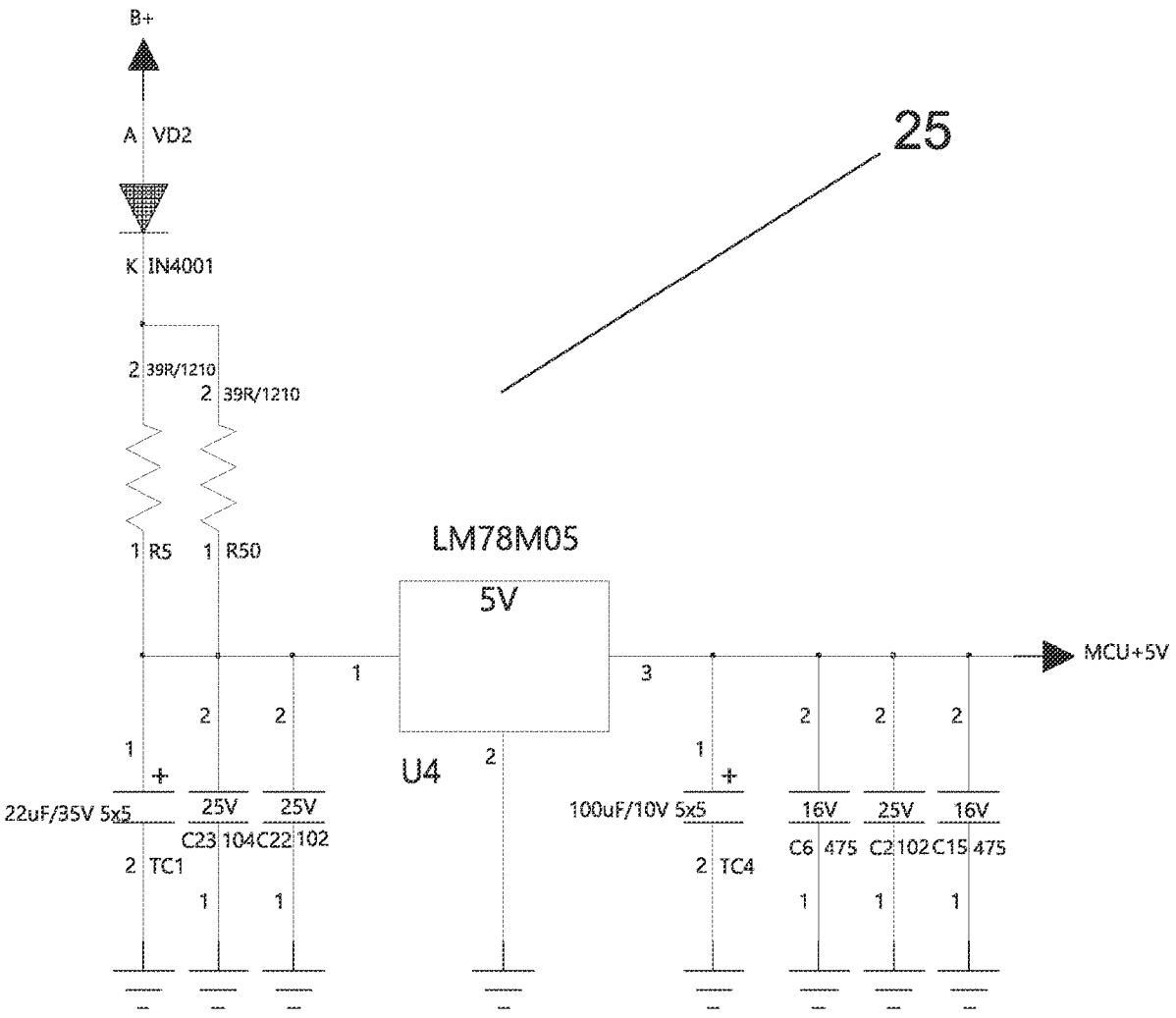
FIG. 8 a circuit diagram of a power supply control circuit in the present invention.

Further, as shown in FIG. 3, the glass substrate 1 is toughened glass. The reflecting area 11 consists of a reflection enhancement layer 111, a metal layer 112, and a protective layer 113 which are sequentially arranged from inside to outside. The reflection enhancement layer 111 is use for enhancing reflection and improving a brightness. The metal layer 112 is used for increasing a hardness of the glass substrate 1. The protective layer 113 is used for isolating erosion of oxygen from the metal layer.

In the embodiment, by sequentially arranging the reflection enhancement layer 111, the metal layer 112, and the protective layer 113 on the glass substrate 1, not only a hardness of the glass substrate 1 can be increased, and a reflectivity and a brightness of the glass substrate 1 are improved, but also an antioxidant capability of the glass substrate 1 is improved, and a service life is prolonged, so that a damage of the glass substrate 1 can be effectively avoided, the antioxidant capability of the glass substrate 1 can also be improved, the glass will never have a black edge, and a service life is greatly prolonged.

Further, as shown in FIG. 4 to FIG. 8, the control module 2 includes a main control logic MCU circuit 21, a high-power lamp strip driving circuit 22, an RGB full-color driving control circuit 23, a demisting control circuit 24, and a power supply control circuit 25.

The main control logic MCU circuit 1 is electrically connected with the touch switch set 6. The high-power lamp strip driving circuit 22 and the RGB full-color driving control circuit 23 are electrically connected with the lamp strip module 3. The demisting control circuit 24 is electrically connected with the demisting module 5.

Further, the demisting module 5 includes an explosion-proof membrane 51 and a heating sheet 52. The explosion-proof membrane 51 is coaxially arranged with the glass substrate 1, and is pasted on the back face of the glass substrate 1 on the reflecting area 11. The heating sheet 52 is pasted on an outer surface of the explosion-proof membrane 51. The heating sheet 52 is electrically connected with the demisting control circuit 24.

In the embodiment, when a surface of the bathroom mirror is misted, an electrical signal is transmitted to the demisting control circuit 24 by manually touching the touch switch set 6, so that the heating sheet 52 is electrified to heat. Heat of the heating sheet 52 is transmitted to the reflecting area 11 of the glass substrate 1, so that a temperature of the glass substrate 1 is increased, thus implementing an effect of effective dimisting. The explosion-proof membrane 51 is used for uniformly transferring heat to the glass substrate 1 to prevent the glass substrate 1 from being damaged due to excessive concentration of heat. Meanwhile, demisting may also be performed comprehensively and quickly.

Further, the reflection enhancement layer 111 is a niobium oxide layer and a silicon oxide layer which are sequentially arranged from inside to outside or a titanium oxide layer and a silicon oxide layer or a pure silver layer which are sequentially arranged from inside to outside. The reflection enhancement layer 111 can enhance reflection and improve a brightness.

Further, the metal layer 112 is a nichrome layer, a metal titanium layer, a metal chromium layer, or a metal copper layer. The metal layer 112 replaces a commonly used aluminum membrane or silver membrane with the nichrome layer, the metal titanium layer, the metal chromium layer, or the metal copper layer, which has effects of increasing a density and a hardness, and prolonging a service life of the bathroom mirror.

Further, the protective layer 113 is one or two of a paint layer or a silicon oxide layer, a niobium oxide layer, a titanium oxide layer, and a silicon nitride layer. The protective layer 113 can not only ensure a bonding strength between the glass substrate 1 and the metal layer in a toughening process, but also effectively isolate erosion of oxygen from the metal layer, thus effectively solving a problem of the black edge of the bathroom mirror after being used for a long time, and prolonging a service life of the bathroom mirror.

Figure 2:
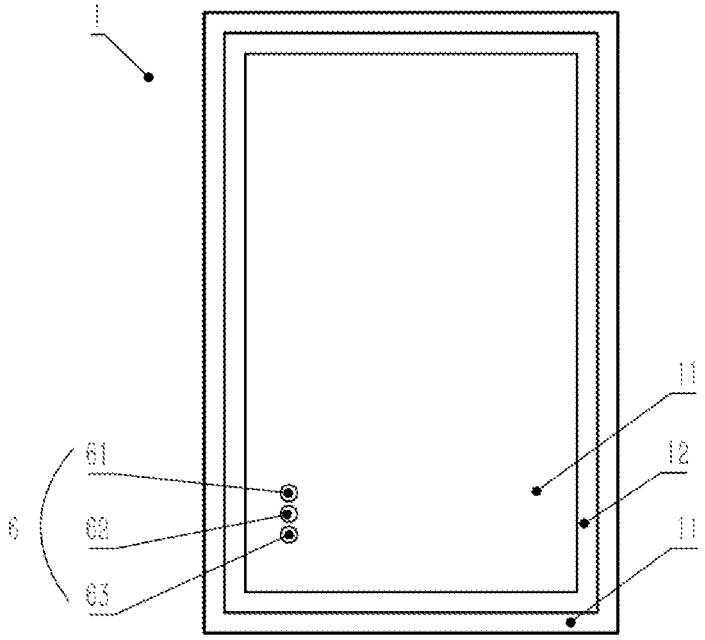
FIG. 2 is a front view of FIG. 1.

Further, as shown in FIG. 2, the touch switch set 6 includes a demisting switch 61, an inner lamp strip control switch 62, and an outer lamp strip control switch 63. The inner lamp strip control switch 62 and the outer lamp strip control switch 63 are respectively used for changing a color and a brightness of the inner lamp strip 31 and the RGB outer lamp strip 32, and are used for controlling on or off of the inner lamp strip 31 and the RGB outer lamp strip 32.

In the embodiment, by setting the control module 2 and a program, the inner light strip 31 has three color changes, respectively including white light, yellow light, and dark light. The RGB outer light strip 32 has eight color changes of iridescent flowing water, and a user may select a favorite color of the inner light strip and a favorite color of the RGB outer light strip 32 by manually pressing and touching the inner light strip control switch 62 and the outer light strip control switch 63 according to use requirements. Meanwhile, a brightness of the inner light strip 31 and a brightness of the RGB outer light strip 32 may be changed by pressing the inner light strip control switch 62 and the outer light strip control switch 63 for a long time. In addition, the inner light strip 31 and the RGB outer light strip 32 may be turned off by pressing the inner light strip control switch 62 and the outer light strip control switch 63 again for 15 seconds.

Further, a cover plate 7 is arranged on one side of the connecting frame 4 far away from the glass substrate 1. A waterproof sealing layer is arranged between the glass substrate 1 and the connecting frame 4, between the connecting frame 4 and the RGB outer lamp strip 32, and between the connecting frame 4 and the cover plate 7. A waterproof performance of the bathroom mirror can be improved through arrangement of the structure.

Further, a surface on a light emitting side of the RGB outer lamp strip 32 is in a frosted structure, by arrangement of the structure, a light emitting brightness of the RGB outer lamp strip 32 can be reduced, so that a light emitting effect is compared with a light emitting effect of the inner lamp strip 31 to increase an overall light emitting stereoscopic effect of the bathroom mirror, thus presenting a colorful effect of more iridescent flowing water.

For those skilled in the art, various other corresponding changes and deformations may be made according to the technical solutions and concepts described above, and all these changes and deformations should fall within the scope of protection of the claims of the present invention.

What is claimed is:

1. An iridescent intelligent bathroom mirror, comprising a glass substrate, a control module, and a lamp strip module, wherein a front face of the glass substrate is provided with a reflecting area and a light emitting area, and a back face of the glass substrate is provided with a coaxial connecting frame;

the lamp strip module comprises an inner lamp strip and an RGB outer lamp strip; the inner lamp strip is arranged on the back face of the glass substrate, and is located on the reflecting area; and the iridescent intelligent bathroom mirror further comprises a demisting module, wherein the demisting module is arranged in a middle of the back face of the glass substrate; a touch switch set is arranged on the reflecting area; and the control module is electrically connected with the lamp strip module, the demisting module, and the touch switch set;

wherein the control module comprises a demisting control circuit the demisting module comprises an explosion-proof membrane and a heating sheet the explosion-proof membrane is coaxially arranged with the glass substrate, and is pasted on the back face of the glass substrate on the reflecting area; the heating sheet is pasted on an outer surface of the explosion-proof membrane; and the heating sheet is electrically connected with the demisting control circuit.

2. The iridescent intelligent bathroom mirror according to claim 1, wherein the glass substrate is toughened glass; the reflecting area consists of a reflection enhancement layer, a metal layer, and a protective layer; the reflection enhancement layer, the metal layer, and the protective layer are sequentially arranged; the reflection enhancement layer is used for enhancing reflection and improving a brightness; the metal layer is used for increasing a hardness of the glass substrate; and the protective layer is used for isolating erosion of oxygen from the metal layer.

3. The iridescent intelligent bathroom mirror according to claim 2, wherein the reflection enhancement layer comprises a niobium oxide layer and a silicon oxide layer; the niobium oxide layer and the silicon oxide layer are sequentially arranged.

4. The iridescent intelligent bathroom mirror according to claim 2, wherein the metal layer is a nichrome layer, a metal titanium lay layer, a metal chromium layer, or a metal copper layer.

5. The iridescent intelligent bathroom mirror according to claim 2, wherein the protective layer is selected from one or two of a group consisting of a paint layer, a silicon oxide layer, a niobium oxide layer, a titanium oxide layer, and a silicon nitride layer.

6. The iridescent intelligent bathroom mirror according to claim 2, wherein the reflection enhancement layer comprises a titanium oxide layer and a silicon oxide layer; the titanium oxide layer and the silicon oxide layer are sequentially arranged.

7. The iridescent intelligent bathroom mirror according to claim 2, wherein the reflection enhancement layer comprises a pure silver layer.

8. The iridescent intelligent bathroom mirror according to claim 1, wherein the control module further comprises a main control logic MCU circuit, a high-power lamp strip driving circuit, an RGB full-color driving control circuit, and a power supply control circuit;

the main control logic MCU circuit is electrically connected with the touch switch set; the high-power lamp strip driving circuit and the RGB full-color driving control circuit are electrically connected with the lamp strip module; and the demisting control circuit is electrically connected with the demisting module.

9. The iridescent intelligent bathroom mirror according to claim 1, wherein the touch switch set comprises a demisting switch, an inner lamp strip control switch, and an outer lamp strip control switch; the inner lamp strip control switch and the outer lamp strip control switch are respectively used for changing a color and a brightness of the inner lamp strip and the RGB outer lamp strip, and are used for controlling on or off of the inner lamp strip and the RGB outer lamp strip.

* * * * *